US008786391B2

(12) United States Patent
Nobusaka et al.

(10) Patent No.: US 8,786,391 B2
(45) Date of Patent: Jul. 22, 2014

(54) REACTOR AND REACTOR APPARATUS

(75) Inventors: Mao Nobusaka, Toyota (JP); Nobuki Shinohara, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/981,205

(22) PCT Filed: Jan. 26, 2011

(86) PCT No.: PCT/JP2011/051388

§ 371 (c)(1),
(2), (4) Date: Jul. 23, 2013

(87) PCT Pub. No.: WO2012/101764

PCT Pub. Date: Aug. 2, 2012

(65) Prior Publication Data

US 2013/0300528 A1 Nov. 14, 2013

(51) Int. Cl.

| | |
|---|---|
| ***H01F 29/00*** | (2006.01) |
| ***H01F 27/02*** | (2006.01) |
| ***H01F 17/06*** | (2006.01) |
| ***H01F 27/24*** | (2006.01) |
| ***H01F 27/26*** | (2006.01) |
| ***H01F 27/08*** | (2006.01) |

(52) U.S. Cl.
USPC ..... 336/67; 336/90; 336/178; 336/212; 336/210; 336/61

(58) Field of Classification Search
USPC ..... 336/90, 61, 65, 67, 210, 212, 178, 221, 336/184, 182
See application file for complete search history.

(56) References Cited

U.S. PATENT DOCUMENTS

| | | | | |
|---|---|---|---|---|
| 2,425,155 | A * | 8/1947 | Jarvis | 242/610.2 |
| 3,374,452 | A * | 3/1968 | Judd | 336/60 |
| 5,210,513 | A * | 5/1993 | Khan et al. | 336/61 |
| 6,445,220 | B1 * | 9/2002 | Franca-Neto | 327/103 |
| 7,164,584 | B2 * | 1/2007 | Walz | 361/704 |
| 7,911,308 | B2 * | 3/2011 | Rippel | 336/182 |
| 2006/0082945 | A1 * | 4/2006 | Walz | 361/103 |
| 2009/0315663 | A1 | 12/2009 | Kiyono et al. | |

FOREIGN PATENT DOCUMENTS

| | | |
|---|---|---|
| JP | U-3096267 | 9/2003 |
| JP | A-2005-073392 | 3/2005 |
| JP | A-2006-344868 | 12/2006 |

(Continued)

OTHER PUBLICATIONS

Nov. 19, 2013 Notice of Allowance issued in Japanese Application No. 2012-554536 (w/ English Translation).

*Primary Examiner* — Alexander Talpalatski
*Assistant Examiner* — Mangtin Lian
(74) *Attorney, Agent, or Firm* — Oliff PLC

(57) ABSTRACT

Provided is a reactor which uses a reactor core in which J-shaped iron cores are oppositely disposed in a ring shape. In the ring shape, an axial outer circumferential part of a first coil wound around a first gap and an axial outer circumferential part of a second coil wound around a second gap overlap each other in an axial direction. Regarding four holding stay parts disposed at four corners of the reactor, the rigidity of the holding stay parts close to the first gap and the second gap is lower than the rigidity of the holding stay parts far from the first gap and the second gap.

3 Claims, 4 Drawing Sheets

(56) References Cited

FOREIGN PATENT DOCUMENTS

| | | |
|---|---|---|
| JP | A-2009-026952 | 2/2009 |
| JP | A-2009-099793 | 5/2009 |
| JP | A-2009-272508 | 11/2009 |
| WO | WO 2008/035807 A1 | 3/2008 |

* cited by examiner

REACTOR AND REACTOR APPARATUS

TECHNICAL FIELD

The present invention relates to a reactor, and to a reactor apparatus having a reactor contained in a housing. The present invention relates more particularly to a reactor formed from a pair of iron cores each including two leg portions having different lengths, and a reactor apparatus having such a reactor contained in a housing.

BACKGROUND ART

A reactor for use in a booster circuit of a power source device or the like may be configured by winding coils around an annularly-formed reactor core.

For example, Patent Document 1 describes that, in a conventional reactor, a pair of U-shaped iron cores are used in an arrangement such that the end faces of their leg portions are placed opposite each other, and a pair of coil bobbins are arranged overlapping each other by being positioned in correspondence to the gaps between the opposing end faces. Patent Document 1 points out that, due to the overlap of the coil bobbins, the widths of the leg portions of the iron cores cannot be increased, resulting in large copper loss and large temperature increase. In view of this, Patent Document 1 discloses use of a pair of J-shaped iron cores in order to avoid the overlapped arrangement of the pair of coil bobbins.

Further, Patent Document 2 discloses a configuration of a power source device in which, in order to prevent propagation of sounds to the outside from a reactor which is a vibration source, the reactor is installed in a region surrounded by a projected portion formed on the bottom surface of a PCU housing, and a reactor cover is secured to the projected portion.

Furthermore, Patent Document 3 describes a reactor manufacturing method, and discloses that, when a reactor and coils are placed in a housing and molding is to be performed using a sealing resin material that exhibits heat dissipation performance, the reactor is preheated. Patent Document 3 describes that, by this preheating, the strength of bonding between the sealing resin material and the reactor is enhanced.

PRIOR ART LITERATURE

Patent Documents

Patent Document 1: JP Utility Model Registration No. 3096267
Patent Document 2: JP 2005-73392 A
Patent Document 3: JP 2009-99793 A

SUMMARY OF THE INVENTION

Problems to be Solved by the Invention

According to Patent Document 1, the annular reactor core is formed from J-shaped iron cores, and the pair of coils are positioned without having any overlapping portions with each other along the axial direction of the coil, so that the size of the reactor along the coil radial direction can be reduced. However, on the other hand, the size of the reactor along the axial direction of the coil becomes increased, and this may result in placing limitations on the manner of arrangement of the reactor inside the power source device.

Further, from the aspect of cooling of the reactor from its side faces, as the pair of coils which correspond to heat generation sources are arranged at positions that are not equidistant from the reactor side faces, it is not easy to cool the two coils evenly.

Moreover, from the aspect of retention of the reactor inside a housing or the like, since the locations of the magnetic gaps which correspond to vibration sources are not equidistant from the four corners of the reactor, depending on the arrangement of the retaining parts, there may occur cases in which uneven vibrations tend to propagate to the housing or the like.

As such, a reactor formed from a pair of J-shaped iron cores still has disadvantages. An object of the present invention is to provide, while using a pair of J-shaped iron cores, a reactor and a reactor apparatus that achieve an enhanced degree of freedom of arrangement within a power source device. Another object of the present invention is to provide, while using a pair of J-shaped iron cores, a reactor and a reactor apparatus that permit efficient cooling. A further object of the present invention is to provide, while using a pair of J-shaped iron cores, a reactor and a reactor apparatus that can suppress propagation of vibrations from the magnetic gaps. The means described below contribute to achieving at least one of these objects.

Means for Solving the Problems

A reactor according to the present invention comprises a reactor core having an annular shape formed by combining a pair of iron cores each having two leg portions with different lengths. A longer one of the two leg portions of a first iron core and a shorter one of the two leg portions of a second iron core are placed opposite each other, and a first gap part is formed therebetween. Further, a shorter one of the two leg portions of the first iron core and a longer one of the two leg portions of the second iron core are placed opposite each other, and a second gap part is formed therebetween. The reactor further comprises a pair of coil parts provided on the annular reactor core, the coil parts including a first coil wound at the first gap part and a second coil wound at the second gap part. The reactor is characterized in that an axial peripheral portion of the first coil and an axial peripheral portion of the second coil are arranged on the reactor core so as to include portions overlapping with each other along the axial direction.

Preferably, the reactor according to the present invention comprises four retaining stay parts provided at four corner portions of the reactor for attaching the reactor to an outer part, wherein, among the four retaining stay parts, a retaining stay part located close to the first gap part and a retaining stay part located close to the second gap part have a lower rigidity than that of a retaining stay part located distant from the first gap part and a retaining stay part located distant from the second gap part.

In the reactor according to the present invention, the retaining stay part located close to the first gap part and the retaining stay part located close to the second gap part preferably have a smaller plate thickness than that of the retaining stay part located distant from the first gap part and the retaining stay part located distant from the second gap part.

A reactor apparatus according to the present invention comprises a housing, a reactor retained in the housing, and a heat dissipating member provided between the reactor and the housing. The reactor comprises a reactor core having an annular shape formed by combining a pair of iron cores each having two leg portions with different lengths. A longer one of the two leg portions of a first iron core and a shorter one of the two leg portions of a second iron core are placed opposite each other, and a first gap part is formed therebetween. Further, a shorter one of the two leg portions of the first iron core and a longer one of the two leg portions of the second iron core are placed opposite each other, and a second gap part is formed therebetween. The reactor further comprises a pair of coil parts provided on the annular reactor core, the coil parts including a first coil wound at the first gap part and a second coil wound at the second gap part. An axial peripheral portion of the first coil and an axial peripheral portion of the second coil are arranged on the reactor core so as to include portions overlapping with each other along the axial direction. The reactor further comprises four retaining stay parts provided at four corner portions of the reactor for attaching the reactor to the housing, wherein, among the four retaining stay parts, a retaining stay part located close to the first gap part and a retaining stay part located close to the second gap part have a lower rigidity than that of a retaining stay part located distant from the first gap part and a retaining stay part located distant from the second gap part.

Achieved Effects of the Invention

According to the above-described configuration, the reactor uses a reactor core that is formed having an annular shape by arranging opposite each other a pair of J-shaped iron cores each having two leg portions with different lengths. In the annular shape of the reactor core, an axial peripheral portion of a first coil wound at a first gap part and an axial peripheral portion of a second coil wound at a second gap part are arranged on the reactor core so as to include portions overlapping with each other along the axial direction. With this arrangement, compared to a structure in which a pair of coils are arranged without having portions overlapping with each other along the axial direction, the reactor size along the coil axial direction can be reduced, and therefore, for example, the degree of freedom of reactor arrangement inside a power source device is enhanced.

Further, as the pair of coils are arranged at positions that are equidistant from side faces of the reactor, the two coils can be cooled evenly.

Further, in the above-described reactor, concerning four retaining stay parts provided at four corner portions of the reactor for attaching the reactor to an outer part, a retaining stay part located close to the first gap part and a retaining stay part located close to the second gap part are configured to have a lower rigidity than that of a retaining stay part located distant from the first gap part and a retaining stay part located distant from the second gap part. By reducing the retaining rigidity at locations close to the magnetic gaps which correspond to vibration sources, it is possible to suppress propagation of vibrations to the housing or the like.

Furthermore, in the above-described reactor, the retaining stay part located close to the first gap part and the retaining stay part located close to the second gap part are configured to have a smaller plate thickness than that of the retaining stay part located distant from the first gap part and the retaining stay part located distant from the second gap part. In this way, the retaining rigidity at locations close to the magnetic gaps which correspond to vibration sources can be reduced by means of a simple configuration.

EMBODIMENTS OF THE INVENTION

Figure 1:
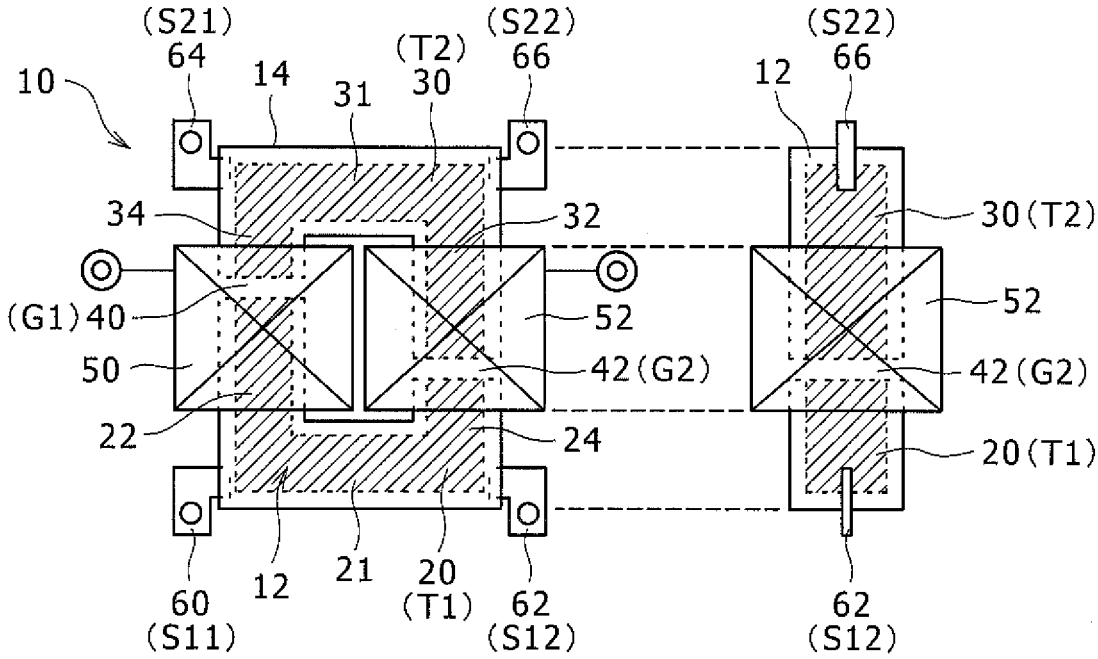
FIG. 1 shows a plan view and a side view for explaining a configuration of a reactor according to an embodiment of the present invention.

Embodiments of the present invention are described below in detail by reference to the drawings. While the following description refers to a reactor and a reactor apparatus for use in a power source device for a vehicle, the power source device may have applications other than for a vehicle. Further, while the following description assumes that each J-shaped iron core used as the reactor core is formed as a single iron core member having a curved shape of letter "J," the iron core may be formed to have a J-shape by combining a plurality of core members. For example, three linear or I-shaped cores may be combined to form a J-shape, or alternatively, an I-shaped core may be additionally coupled to one leg portion (among two leg portions) of a single U-shaped core to form a J-shape.

While the following description assumes that the J-shaped iron core is a dust core molded using magnetic powder, the iron core may alternatively be formed by die-cutting a predetermined shape from an electromagnetic steel plate. Further, while it is assumed in the below description that a housing that retains the reactor is a power source device housing, the housing may alternatively be a reactor housing for containing the reactor. Moreover, the materials, dimensions, and shapes referred to in the below description are examples only, and can be changed as appropriate in accordance with applications and the like.

Throughout the drawings, the same elements are labeled with the same reference numerals, and descriptions thereof are not repeated, in order to avoid redundancy. Further, in the following description, previously-mentioned reference numerals may be again referred to as necessary.

FIG. 1 shows a plan view and a side view of a reactor 10. In the following description, the term "reactor" is used to refer to an element formed by winding coils around an iron core and having retaining parts for attachment to a housing, while the term "reactor apparatus" is used to refer to an element obtained by attaching a reactor to a housing by means of the retaining parts. The reactor 10 is an element used in a booster circuit of a vehicle power source device installed in a hybrid vehicle, electric vehicle, or the like, and is positioned inside the housing of the power source device by means of the retaining parts.

The reactor 10 comprises a reactor core 12, a molded part 14 that coats the reactor core 12 with resin, a pair of coils 50, 52 wound on the outer periphery of the molded part, and four retaining stay parts 60, 62, 64, 66 projecting from the four corners of the molded part 14.

The reactor core 12 is a magnetic body formed to have an annular shape by combining a pair of iron cores 20, 30. Each of the two iron cores 20, 30 has two leg portions with different lengths, and has a plan-view shape of the letter "J". In FIG. 1, distinction between the two iron cores 20, 30 is made by labeling with "T1" and "T2." Dust cores formed by molding magnetic powder into a J-shape are used as the iron cores 20, 30.

Assuming that T1 denotes the first iron core 20, the first iron core 20 includes a longer leg portion 22, a shorter leg portion 24, and a trunk portion 21 connecting between these two leg portions. Further, assuming that T2 denotes the second iron core 30, the second iron core 30 includes a longer leg portion 32, a shorter leg portion 34, and a trunk portion 31 connecting between these two leg portions. Concerning the first iron core 20 and the second iron core 30, their trunk portions 21, 31 have the same length, their longer leg portions 22, 32 have the same length, and their shorter leg portion 24, 34 have the same length. In other words, the first iron core 20 and the second iron core 30 have outer shapes identical with each other.

The reactor core 12 is formed to have an annular shape by configuring the longer leg portion 22 of the first iron core 20 and the shorter leg portion 34 of the second iron core 30 to be placed opposite each other, and configuring the shorter leg portion 24 of the first iron core 20 and the longer leg portion 32 of the second iron core 30 to be placed opposite each other. Here, the gap at which the longer leg portion 22 of the first iron core 20 and the shorter leg portion 34 of the second iron core 30 face each other is referred to as a first gap part 40, and the gap at which the shorter leg portion 24 of the first iron core 20 and the longer leg portion 32 of the second iron core 30 face each other is referred to as a second gap part 42. In FIG. 1, the first gap part 40 is labeled "G1," and the second gap part 42 is labeled "G2." An appropriate non-magnetic material is inserted in each of the first gap part 40 and the second gap part 42 to thereby constitute magnetic gaps in the reactor core 12.

The term "molded part 14" is used to collectively refer to two mold-ons, which include a first iron core mold-on that coats, with resin, the overall first iron core 20 while exposing its end surface facing the first gap part 40 and its end surface facing the second gap part 42, and a second iron core mold-on that coats, with resin, the overall second iron core 30 while exposing its end surface facing the first gap part 40 and its end surface facing the second gap part 42. In other words, both of the first iron core 20 and the second iron core 30 are entirely coated with resin except at parts that constitute the magnetic gaps. An appropriate plastic resin having heat resistance and electrical insulation may be used as the resin of the molded part 14.

The pair of coils 50, 52 comprise a first coil 50 wound at the first gap part 40 and a second coil 52 wound at the second gap part 42 in the annular shape of the reactor core 12. The first coil 50 and the second coil 52 are each configured by winding an insulated conductor wire on an appropriate bobbin by a predetermined number of windings. The two coils 50, 52 are serially connected to each other, and, in terms of an equivalent circuit, correspond to a single coil wound around the reactor core 12 serving as an iron core. In FIG. 1, double-circle symbols denote a first terminal drawn out from the first coil 50 side and a second terminal drawn out from the second coil 52 side. The first coil 50 and the second coil 52 have the same number of windings.

The first coil 50 is arranged covering the first gap part 40, and the second coil 52 is arranged covering the second gap part 42. Meanwhile, the axial peripheral portion of the first coil 50 and the axial peripheral portion of the second coil 52 are arranged so as to include portions overlapping with each other along the axial direction. Significance of the overlapping arrangement along the axial direction is described later by reference to FIGS. 2 and 3.

The retaining stay parts 60, 62, 64, 66 are four retaining parts projecting from the four corners of the molded part 14, and serve to attach and retain the reactor 10 on an outer housing. Each of the retaining stay parts 60, 62, 64, 66 may be a member configured by embedding one end of an appropriate metal plate in the molded part 14 and having the other end exposed from the molded part 14.

In FIG. 1, distinction among the four retaining stay parts 60, 62, 64, 66 is made by labeling with "S11," "S12," "S21," and "S22." S11 denotes the retaining stay part 60 provided on the first iron core 20 of the reactor 12 on the first gap part 40 side, and this member will be referred to as "No. 11 stay" (S11 meaning No. 11). In a similar manner, S12 denotes the retaining stay part 62 provided on the first iron core 20 on the second gap part 42 side, and this member will be referred to as "No. 12 stay." S21 denotes the retaining stay part 64 provided on the second iron core 30 on the first gap part 40 side, and this member will be referred to as "No. 21 stay." S22 denotes the retaining stay part 66 provided on the second iron core 30 on the second gap part 42 side, and this member will be referred to as "No. 22 stay."

The "S21" retaining stay part 64 located close to the first gap part 40 and the "S12" retaining stay part 62 located close to the second gap part 42 have a plate thickness that is smaller than that of the "S11" retaining stay part 60 located distant from the first gap part 40 and the "S22" retaining stay part 66 located distant from the second gap part 42. The side view in FIG. 1 shows that the plate thickness of the "S12" retaining stay part 62 is smaller than that of the "S22" retaining stay part 66.

In other words, the retaining stay parts 62, 64 located close to the magnetic gap parts are configured to have rigidity that is lower than that of the retaining stay parts 60, 66 located distant from the magnetic gap parts. Other than by reducing the plate thickness as described above, rigidity may be lowered alternatively by adopting a shape that facilitate bending. For example, the retaining stay parts 62, 64 may each have a root portion connecting to the molded part 14 that has a width narrower than that of the root portion of the retaining stay parts 60, 66 connecting to the molded part 14. Significance of providing the difference in rigidity is described later by reference to FIGS. 7 and 8.

Figure 2:
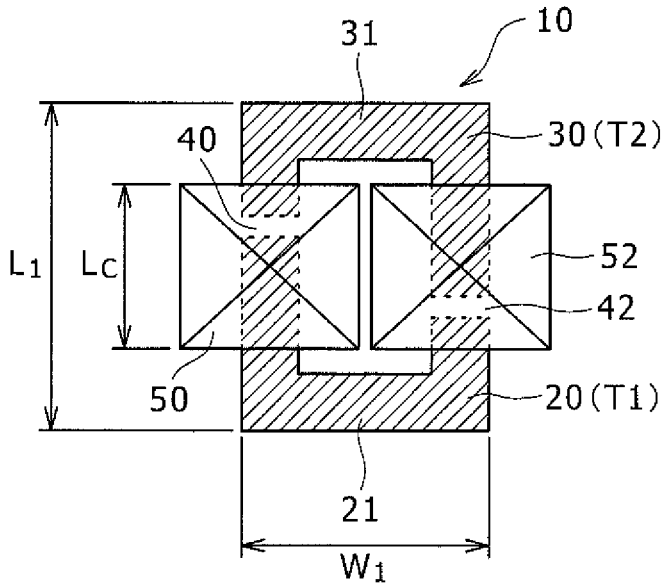
FIG. 2 is a diagram showing dimension relationships in the reactor of FIG. 1.
Figure 3:
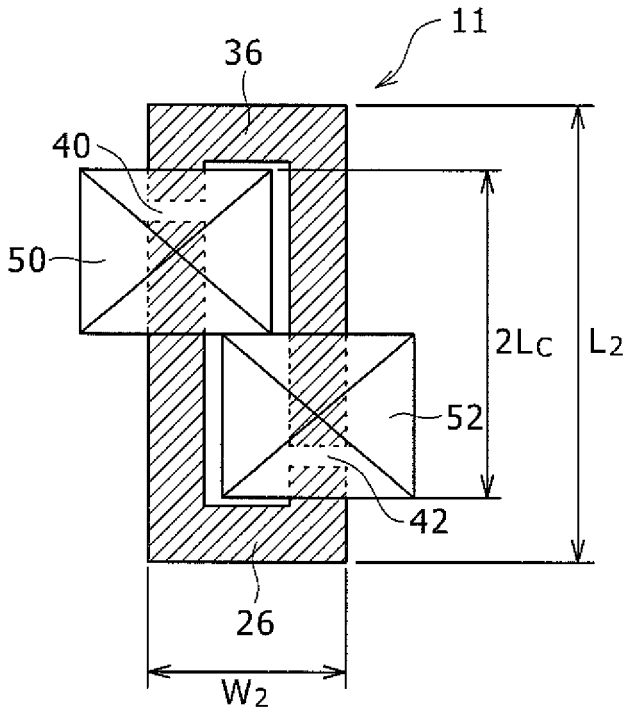
FIG. 3 is a diagram showing dimension relationships in a conventional reactor, for comparison with FIG. 2.

FIGS. 2 and 3 are diagrams for explaining the overlapping arrangement along the axial direction. FIG. 2 is a schematic diagram showing the first iron core 20, second iron core 30, first coil 50, and second coil 52 by extracting from FIG. 1. FIG. 3 is a diagram showing a conventional art configuration of a reactor 11 employing J-shaped iron cores, and is a schematic diagram extracting and showing the first iron core 20, second iron core 30, first coil 50, and second coil 52. In FIGS. 2 and 3, identical first coils 50 and second coils 52 are used. In FIG. 3, the axial peripheral portion of the first coil 50 and the axial peripheral portion of the second coil 52 are arranged without having portions overlapping with each other along the axial direction.

It is assumed that the axial length of each of the first coil 50 and the second coil 52 is denoted by LC. In FIG. 2, the axial peripheral portion of the first coil 50 and the axial peripheral portion of the second coil 52 are arranged so as to include portions overlapping with each other along the axial direction. Accordingly, the axial size L1 of the reactor 10 of FIG. 2 is substantially equal to a value obtained by adding the width of the trunk portion 21 of the first iron core 20 and the width of the trunk portion 31 of the second iron core 30 to LC. Further, the widthwise size W1 of the reactor 10 of FIG. 2 is substantially equal to a value obtained by adding the widthwise size of the first coil 50 and the widthwise size of the second coil 52.

Here, the "axial" direction of the reactor 10 denotes the direction parallel to the axial direction of the first coil 50 and the second coil 52, and corresponds to the extending direction of the leg portions 22, 24 of the first iron core 20 and the leg portions 32, 34 of the second iron core 30. The "width" direction of the reactor 10 denotes a direction orthogonal to the axial direction, and corresponds to the extending direction of the trunk portion 21 of the first iron core 20 and the trunk portion 31 of the second iron core 30.

In contrast to the above, in the conventional art reactor 11, the axial peripheral portion of the first coil 50 and the axial peripheral portion of the second coil 52 are arranged without having portions overlapping with each other along the axial direction. Accordingly, the widthwise size W2 of the reactor 11 of FIG. 3 is substantially equal to a value obtained by adding the widthwise size of the first coil 50 and the widthwise size of the second coil 52 and then subtracting therefrom the size of the portions overlapping along the width direction. The size of the portions overlapping along the width direction between the first coil 50 and the second coil 52 corresponds to the radial size of the winding wire portion of each coil. The axial size L2 of the reactor 11 of FIG. 3 is substantially equal to a value obtained by adding the width of the trunk portion 21 of the first iron core 20 and the width of the trunk portion 31 of the second iron core 30 to 2LC.

By comparing the configurations of FIGS. 2 and 3, it is recognized that the axial size L1 of the reactor 10 of FIG. 2 is reduced from the axial size L2 of the reactor 11 of FIG. 3 by the value of Lc. Meanwhile, the widthwise size W2 of the reactor 11 of FIG. 3 is reduced from the widthwise size W1 of the reactor 10 of FIG. 2 by the value of the radial size of the coil winding wire portion. In this way, in the reactor 11 of FIG. 3, the widthwise size W2 can be reduced, but the axial size L2 is increased. In the reactor 10 of FIG. 2, the widthwise size W1 is increased, but the axial size L1 can be reduced. The size in the height direction, which is perpendicular to both of the axial direction and the width direction, is the same in the two reactors 10, 11.

When actually placing a reactor inside a power source device housing, the axial size and the widthwise size may become points of issue. In cases in which placement is facilitated by reduced widthwise size, it is advantageous in terms of placement to employ the configuration of the reactor 11. On the other hand, in cases in which placement is facilitated by reduced axial size, it is advantageous in terms of placement to employ the configuration of the reactor 10. As such, by employing the configuration of the reactor 10 of FIG. 2 aside from the configuration of the reactor 11 of FIG. 3, a higher degree of freedom can be attained in arranging the reactor inside the power source device housing.

For example, when components other than the reactor, such as an inverter circuit and a DC-DC converter, are to be placed inside a power source device housing, there may be cases in which, due to size relationships among the components, some extra space is available for the widthwise size of the reactor but a minimized axial size is desirable. In such cases, by adopting the configuration of the reactor 10, a compact power source device can be attained. Other achieved effects of the reactor 10 having the configuration different from the conventional art are described below.

Figure 4:
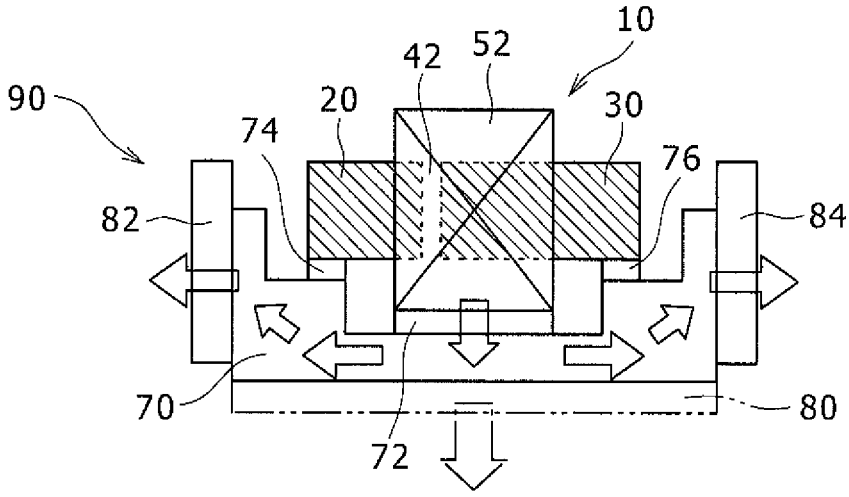
FIG. 4 is a diagram showing a manner of cooling achieved by the reactor of FIG. 1.
Figure 5:
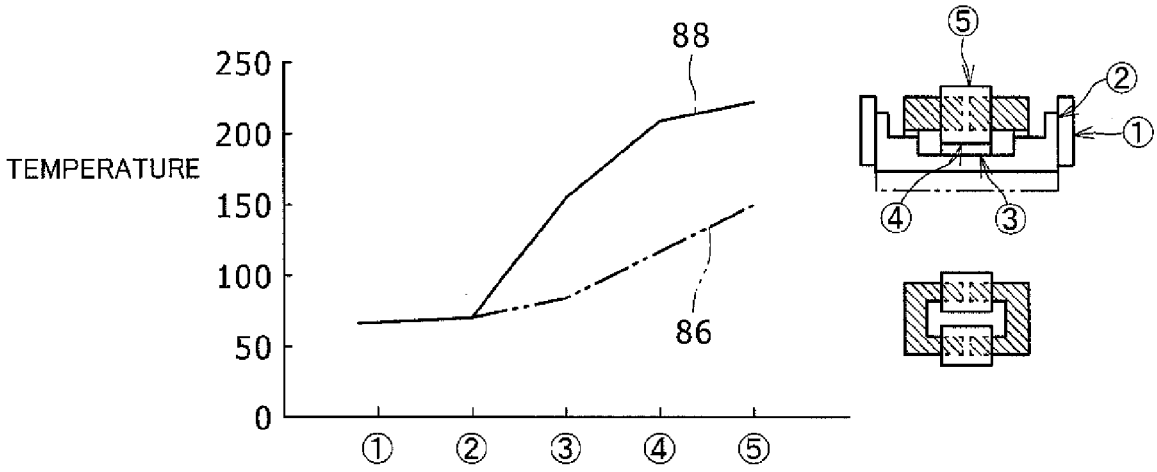
FIG. 5 is a diagram showing a manner of cooling by referring to conventional art U-shaped cores as an example.
Figure 6:
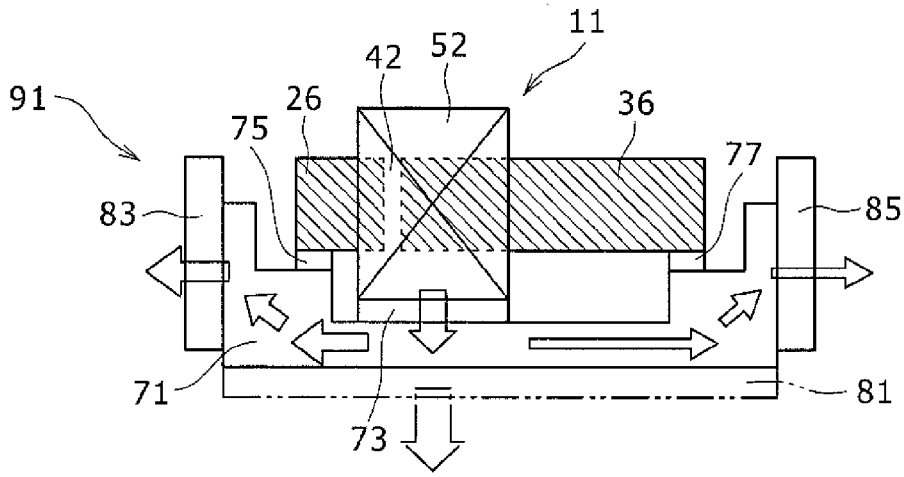
FIG. 6 is a diagram for explaining cooling in a conventional art reactor, for comparison with FIG. 4.
Figure 7:
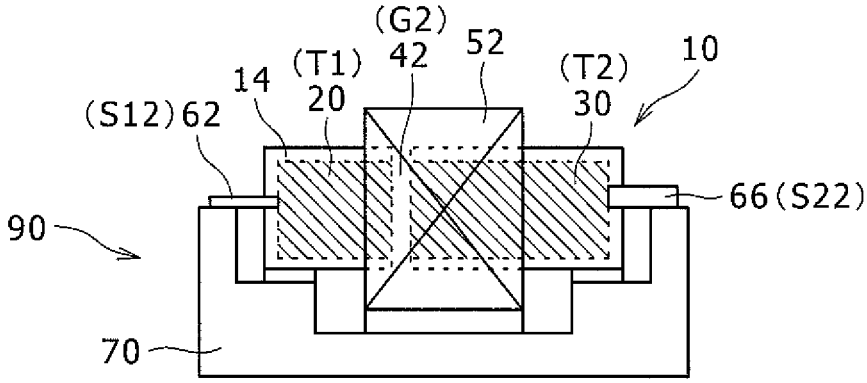
FIG. 7 is a diagram showing a manner of retention with respect to vibrations, as achieved by the reactor of FIG. 1.
Figure 8:
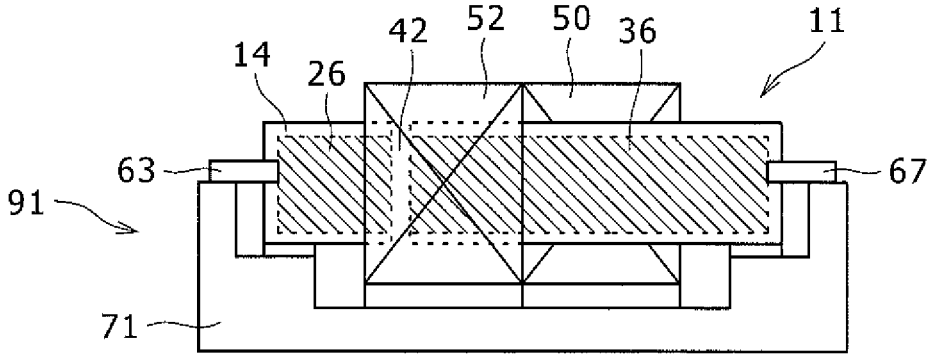
FIG. 8 is a diagram showing a manner of retention in a conventional art reactor, for comparison with FIG. 7.

FIGS. 4 to 8 are diagrams for explaining the achieved effects of the reactor apparatus 90 formed by placing the reactor 10 inside a power source device housing 70, in comparison to the achieved effects of the reactor apparatus 91 formed by placing the reactor 11 inside a power source device housing 71. FIGS. 4 to 6 are diagrams for explaining the cooling effect, and FIGS. 7 and 8 are diagrams for explaining the vibration propagation suppressing effect.

The reactor apparatus 90 shown in FIG. 4 is formed by placing the reactor 10 inside the power source device housing 70. In this embodiment, heat-dissipating resin members 72, 74, 76 are disposed between the reactor 10 and the power source device housing 70. The heat-dissipating resin members 72, 74, 76 are resin layers provided for electrically insulating between the reactor 10 and the power source device housing 70 and for guiding heat generated in the reactor 10 upon operation toward the power source device housing 70. Here, the heat-dissipating resin member 72 is disposed between the coils 50, 52 and the power source device housing 70, and the heat-dissipating resin members 74, 76 are disposed between the first and second iron cores 20, 30 and the power source device housing 70. An appropriate plastic resin having sufficient heat resistance and heat conductivity can be used as the heat-dissipating resin.

The power source device housing 70 is provided with a heat dissipation part. A mode in which a heat dissipation part 80 is provided at the bottom portion of the power source device housing 70 is referred to as the lower part cooling mode. A mode in which heat dissipation parts 82, 84 are provided vertically inside the power source device housing 70 and the reactor 10 is placed therebetween is referred to as the double-sided cooling mode. Characteristics of these two cooling modes are explained by reference to FIG. 5.

FIG. 5 is a diagram showing a manner of cooling of a reactor apparatus formed by placing inside a housing a reactor configured by combining a pair of U-shaped iron cores to form an annular shape and winding a pair of coils thereon. Here, a U-shaped iron core is an iron core in which its two leg portions bending and protruding from a trunk portion of the iron core have identical lengths. In a reactor formed using a pair of U-shaped iron cores, since the coils are arranged at positions of center of symmetry of the reactor, cooling can be achieved uniformly without unevenness, according to both of the double-sided cooling mode and the lower part cooling mode. For this reason, a reactor apparatus employing U-shaped iron cores is referred to in FIG. 5 as one of the best examples for explaining a manner of cooling.

In FIG. 5, the horizontal axis indicates temperature measurement location in the reactor apparatus, and the vertical axis indicates temperature. Temperature measurement location 1 is a temperature measurement location at a supplied coolant, and a temperature measured at this location indicates the temperature of the supplied coolant. Temperature measurement location 2 is a location at which a heat dissipation part and the housing contact each other. In the lower part cooling mode, the temperature measurement location 2 is a location at which the bottom surface of the housing and a heat dissipation part contact each other. In the double-sided cooling mode, the temperature measurement location 2 is a location at which a side surface of the housing and a heat dissipation part contact each other. Temperature measurement location 3 is a location at which a bottom surface of the housing and a heat-dissipating resin member contact each other. Temperature measurement location 4 is a location at which a heat-dissipating resin member and a coil contact each other. Temperature measurement location 5 is a location for measuring a coil surface temperature.

In FIG. 5, the solid line illustrates a temperature characteristic 86 obtained when the lower part cooling mode is used during operation of the reactor, and the dashed line illustrates a temperature characteristic 88 obtained when the double-sided cooling mode is used. As shown in the figure, the highest temperatures are the coil surface temperatures. Further, in general, cooling performance with respect to the coils is higher in the lower part cooling mode compared to the double-sided cooling mode. However, depending on the individual power source device, there may be cases in which the lower part cooling mode cannot be adopted, and therefore the double-sided cooling mode is to be used. In such cases, the temperature of the supplied coolant and the like are to be set so that the temperature characteristic 88 does not lead to degradation of reactor performance.

Referring again to the reactor apparatus 90 of FIG. 4, in the reactor 10 placed in the reactor apparatus 90, although the first gap part 40 and the second gap part 42 are not arranged at positions of center of symmetry of the reactor 10, the coils 50, 52 are arranged at positions of center of symmetry of the reactor 10 as shown in FIG. 2. In this regard, the reactor apparatus 90 is similar to the reactor apparatus of FIG. 5 formed using U-shaped iron cores. That is to say, even when the double-sided cooling mode is employed, heat flow caused by heat generation in the coils 50, 52 is propagated evenly to the heat dissipation parts 82, 84 disposed on the two sides of the power source device housing 70, so that imbalance in cooling does not occur. Accordingly, the temperature characteristic 88 shown in FIG. 5, which is obtained in the case of uniform cooling, can be used to appropriately set the temperature of the supplied coolant and the like.

FIG. 6 is a diagram for explaining a manner of cooling in a reactor apparatus 91 in which a conventional art reactor 11 is placed in a power source device housing 71. In this reactor 11, all of the first gap part 40, second gap part 42, and coils 50, 52 are not arranged at positions of center of symmetry of the reactor 11, as shown in FIG. 3. Accordingly, when the double-sided cooling mode is employed, heat flow caused by heat generation in the coils 50, 52 is propagated unevenly via the heat-dissipating resin members 73, 75, 77 in accordance with the distances between the heat dissipation parts 83, 85 and the coils 50, 52, so that cooling becomes unbalanced. In FIG. 6, heat flow caused by heat generation in the coil 52 is illustrated using hollow arrows. Compared to the heat flow toward the heat dissipation part 83 located close to the coil 52, the heat flow toward the heat dissipation part 85 located distant from the coil 52 is less smooth.

In contrast to such a conventional art reactor, the reactor 10 having the configuration shown in FIG. 1 upon incorporation into the reactor apparatus 90 exhibits an enhanced cooling performance even when the double-sided cooling mode is employed.

FIGS. 7 and 8 are diagrams for explaining the vibration propagation suppressing effect of the reactor 10 in comparison with the conventional art reactor 11. As described by reference to FIG. 1, in the reactor 10, the retaining stay parts 62, 64 located close to the magnetic gap parts are configured to have lower rigidity than that of the retaining stay parts 60, 66 located distant from the magnetic gap parts. In the conventional art reactor 11, the respective retaining stay parts have the same rigidity.

FIG. 7 is a diagram similar to FIG. 4, but illustrates a view of the reactor apparatus 90 in which the reactor 10 is attached to and retained in the power source device housing 70 by the four retaining stay parts 60, 62, 64, 66. Specifically, in FIG. 7, the reactor 10 is attached to the power source device housing 70 by means of the retaining stay part 62 having low rigidity, which is labeled "S12," and the retaining stay part 66 having ordinary rigidity, which is labeled "S22."

When the reactor 10 is operated, gap intervals become varied in the first and second gap parts 40, 42 corresponding to the magnetic gaps, resulting in generation of vibrations. In other words, the vibration sources are parts in the vicinity of the first and second gap parts 40, 42 corresponding to the magnetic gaps. Here, the retaining stay parts 62, 64 located close to the vibration sources have lower rigidity than that of the retaining stay parts 60, 66 located distant from the vibration sources. In FIG. 7, the retaining stay part 62, which is labeled "S12" and located close to the second gap part 42 labeled "G2," has a smaller plate thickness than that of the retaining stay part 66, which is labeled "S22" and located distant from G2.

By configuring as described above, while rigidity for retention of the reactor 10 in the power source device housing 70 is ensured by the rigidity of the retaining stay parts 60, 66 located distant from the vibration sources, vibrations can be absorbed by the retaining stay parts 62, 64 having low rigidity, which are located close to the vibration sources. As a result, it is possible to suppress propagation of vibrations from the vibration sources to the power source device housing 70.

FIG. 8 is a diagram similar to FIG. 6. Here, the four retaining stay parts used to attach the reactor 11 to the power source device housing 71 have the same rigidity, which is unchanged from ordinary rigidity. FIG. 8 shows that the plate thickness of the retaining stay part 63 located close to the second gap part 42 is the same as the plate thickness of the retaining stay part 67 located distant from the second gap part 42.

When the reactor 11 is operated, gap intervals become varied in the first and second gap parts 40, 42 corresponding to the magnetic gaps, resulting in generation of vibrations. Here, as the respective retaining stay parts have the same rigidity, large vibrations are propagated from the retaining stay parts located close to the vibration sources to the power source device housing 71. These vibrations are larger than the vibrations propagated from the retaining stay parts located distant from the vibration sources to the power source device housing 71.

In contrast to such a conventional art reactor, the reactor 10 having the configuration of FIG. 1 upon incorporation into the reactor apparatus 90 exhibits an enhanced vibration suppression performance.

INDUSTRIAL APPLICABILITY

A reactor and a reactor apparatus according to the present invention can be used for a power source device.

LIST OF REFERENCE NUMERALS

10, 11 reactor; 12 reactor core; 14 molded part; 20, 30 iron core; 21, 31 trunk portion; 22, 24, 32, 34 leg portion; 40 first gap part; 42 second gap part; 50, 52 coil; 60, 62, 63, 64, 66, 67 retaining stay part; 70, 71 power source device housing; 72, 73, 74, 75, 76, 77 heat-dissipating resin member; 82, 83, 84, 85 heat dissipation part; 86, 88 temperature characteristic; 90, 91 reactor apparatus.

The invention claimed is:

1. A reactor, comprising:

a reactor core having an annular shape formed by combining a pair of iron cores each having two leg portions with different lengths, wherein a longer one of the two leg portions of a first iron core and a shorter one of the two leg portions of a second iron core are placed opposite each other and a first gap part is formed therebetween, while a shorter one of the two leg portions of the first iron core and a longer one of the two leg portions of the second iron core are placed opposite each other and a second gap part is formed therebetween;

a pair of coil parts provided on the annular reactor core, the coil parts including a first coil wound at the first gap part and a second coil wound at the second gap part, wherein an axial peripheral portion of the first coil and an axial peripheral portion of the second coil are arranged on the reactor core so as to include portions overlapping with each other along the axial direction; and four retaining stay parts provided at four corner portions of the reactor for attaching the reactor to an outer part, wherein, among the four retaining stay parts, a retaining stay part located close to the first gap part and a retaining stay part located close to the second gap part have a lower rigidity than that of a retaining stay part located distant from the first gap part and a retaining stay part located distant from the second gap part.

2. The reactor according to claim 1, wherein the retaining stay part located close to the first gap part and the retaining stay part located close to the second gap part have a smaller plate thickness than that of the retaining stay part located distant from the first gap part and the retaining stay part located distant from the second gap part.

3. A reactor apparatus, comprising:

a housing;

a reactor retained in the housing; and a heat dissipating member provided between the reactor and the housing, wherein the reactor comprises:

a reactor core having an annular shape formed by combining a pair of iron cores each having two leg portions with different lengths, wherein a longer one of the two leg portions of a first iron core and a shorter one of the two leg portions of a second iron core are placed opposite each other and a first gap part is formed therebetween, while a shorter one of the two leg portions of the first iron core and a longer one of the two leg portions of the second iron core are placed opposite each other and a second gap part is formed therebetween;

a pair of coil parts provided on the annular reactor core, the coil parts including a first coil wound at the first gap part and a second coil wound at the second gap part, wherein an axial peripheral portion of the first coil and an axial peripheral portion of the second coil are arranged on the reactor core so as to include portions overlapping with each other along the axial direction; and four retaining stay parts provided at four corner portions of the reactor for attaching the reactor to the housing, wherein, among the four retaining stay parts, a retaining stay part located close to the first gap part and a retaining stay part located close to the second gap part have a lower rigidity than that of a retaining stay part located distant from the first gap part and a retaining stay part located distant from the second gap part.

* * * * *